United States Patent [19]

Schleck

[11] Patent Number: 4,641,477

[45] Date of Patent: Feb. 10, 1987

[54] ADJUSTABLE MODULAR BUILDING

[76] Inventor: Herman A. Schleck, Lamar Tower, Suite 2108, 2929 Buffalo Speedway, Houston, Tex. 77098

[21] Appl. No.: 816,436

[22] Filed: Jan. 6, 1986

[51] Int. Cl.[4] ..... E04B 1/342; E04B 1/343; E04B 1/32; E04B 1/348

[52] U.S. Cl. ..... 52/646; 52/86

[58] Field of Search ..... 52/640, 641, 646, 86, 52/655, 654, 643, 645, 637, 635; 14/5, 3.2; 182/152

[56] References Cited

U.S. PATENT DOCUMENTS

| | | | |
|---|---|---|---|
| 1,026,845 | 5/1912 | Bishop | 52/645 |
| 1,112,542 | 10/1914 | Loser | 52/640 |
| 1,554,224 | 9/1925 | McGrath | 52/646 |
| 2,603,171 | 7/1952 | Smith | 52/64 |
| 4,017,932 | 4/1977 | Lotto | 52/646 |

FOREIGN PATENT DOCUMENTS

| | | | |
|---|---|---|---|
| 000585 | 4/1980 | Japan | 52/641 |
| 152435 | 11/1955 | Sweden | 52/645 |

*Primary Examiner*—John E. Murtagh

*Attorney, Agent, or Firm*—Larson and Taylor

[57] ABSTRACT

An adjustable modular building unit is used to construct a truss structure of any given size and shape which is joined with other truss structures to form a building. Before adjustment, the modular building unit has a six-sided rectangular parallelepiped shape. However, the bottom of the modular building unit and a diagonal brace member are adjustable in length so that the vertical, lengthwise cross section of the modular building unit is adjustable to various isosceles trapezoidal configurations. Preferably, the modular building unit is constructed of various chord members so that each side forming the trapezoidal configuration is rotatably connected to the adjacent side and the diagonal brace member provides stability. In order to construct the truss, each building unit is releasably attached to an adjacent building unit which has been appropriately adjusted. A base unit for each end of the truss is also provided which includes a rotatably side supporting plate. With such base units, the truss is connected in a plane parallel to horizontal and raised to vertical about the pivot axes of the base units.

12 Claims, 10 Drawing Figures

ADJUSTABLE MODULAR BUILDING

FIELD OF THE INVENTION

The present invention relates generally to a truss structure for a building, and more particularly to a truss structure made of adjustable modular building elements.

BACKGROUND OF THE INVENTION

Various truss designs have been disclosed in the prior art which are used to construct a building. For example, in U.S. Pat. No. 2,789,668 (Martin), a portable storage shelter is disclosed which is composed of a series of arched units arranged longitudinally along a trackway. These arched units are constructed to permit preselected sections throughout the length of the building structure to be tilted, telescoped, nested one on the other, shifted apart or switched, and rolled clear to give free and ready access to the stored objects. Each arched rib section is constructed of tubular curved inner and outer a frame members welded together. In U.S. Pat. No. 3,220,152 (Sturm), a truss structure is disclosed which is constructed of a plurality of prefabricated tetrachodron frame units. Each tetrachodron frame unit is comprised of struts, and the struts are joined to a connecting member which is either spherical or a truncated cone geometric shape.

Another structural system for constructing a building is disclosed in U.S. Pat. No. 3,722,153 (Baer). The building structure is based upon the utilization of the five-fold symmetries of the icosahedron and its dual, the dodechedron. Utilizing these symmetries, a structure is constructed which consists of a plurality of basic building blocks or cells. Each of these cells is comprised of a plurality of structure elements joined together in the form of a four sided rhomboidal planar figure. Ball connectors are used to connect the primary structural elements together. Some of the basic building blocks themselves have a parallelepiped shape. Another structure constructed from domed cross sections is disclosed is U.S. Pat. No. 3,925,942 (Hemmelsbach). Each truss section is formed of inverted pyramidal truss units. The pyramidal truss units are constructed of tubular members which are flattened at the ends and bolted together.

A building truss structure made of individual tubular sections of only two different lengths is disclosed in U.S. Pat. No. 3,501,876 (Engle). The individual tube sections are connected at each end to other tube sections to form the structure. A rectangular member which is used to form a truss structure is disclosed in U.S. Pat. No. 4,284,094 (Behrend). The truss structure is held together by cables which run through both longitudinal members of each rectangular section.

SUMMARY OF THE INVENTION

In accordance with the present invention, a six-sided parallelepiped frame member which is used as a modular building element for constructing a truss structure is provided. The parallelepiped frame member includes generally rectangular top, bottom, left and right sides. Adjacent sides are rotatably connected to one another by suitable connecting means. An adjusting means is also provided for adjusting the length of the bottom side between the left side and right side. A diagonal brace member, which extends diagonally between the top and bottom sides, is also provided for stability. The length of this brace member is also adjustable by a suitable brace adjusting means. In order to form the truss structure, an attaching means is provided for attaching the right side of one frame member to the left side of an adjacent frame member such that a string of attached frame members forms the truss structure. The specific configuration of the truss structure is determined by initially varying the lengths of the bottom side and diagonal brace member of each frame member before assembly.

In the preferred embodiment, the top side is formed of two top chord members of equal length extending parallel, the bottom side is formed of two bottom chord members extending parallel to the top chord members, the right side is formed of two right chord members extending parallel to one another, and the left side is formed of two left chord members extending parallel from to one another and to the right chord members. Each of these chord members then has opposite ends in the form of rigid collars with the longitudinal axis of the rigid collar perpendicular to the respective chord members. With this construction, the connecting means is an axle passing through respective adjacent collars. The brace adjusting means and bottom adjusting means are also preferably turnbuckle members.

In order to form the truss structure, a base unit is also preferably used. The base unit comprises a base member, a side engaging member, and an attaching means for attaching one of the left or right sides of the first frame member of the truss structure to the side engaging member. A pivot means is also provided for pivotally attaching the side engaging member to the base member for rotation about an axis parallel to a longitudinal axis of the one of the left side or right side.

In a preferred embodiment, a base unit is provided at each end of the truss structure. The base unit is provided with wheels so that the truss structure is movable to a desired location. In addition, the attaching means attaches axles of one frame member to respective axles of an adjacent frame member. Conveniently, this is done with a releasable holding means such as a bolt and nut.

It is an object of the present invention to provide adjustable modular building elements for the construction of a truss, and so that a plurality of trusses similarly constructed are usable to form a building.

It is also an object of the present invention to provide modular building elements which are reusable and which are adjustable so that buildings of various sizes and shapes are constructed.

It is an advantage of the present invention that trusses according to the present invention are constructed without the use of construction cranes, and thus a building can be constructed without the use of construction cranes.

It is also an advantage of the present invention that the trusses erected are movable away from the location where the truss is constructed such that the building formed by a plurality of trusses is similarly movable.

It is a further advantage of the present invention that the length of the building constructed is dependent upon the number of trusses constructed and aligned side to side. In addition, the span or width of the building is also dependent on the number of modular units used and the adjustment made to the modular units. Therefore, building of various sizes and lengths are easily made with the adjustable modular building elements of the present invention.

It is still another advantage of the present invention that a building constructed of movable trusses is thus movable over a structure which needs protection, but which makes construction of a building over the structure difficult or impossible.

Other features, objects, and advantages of the present invention are stated in or apparent from a detailed description of a presently preferred embodiment of the invention found hereinbelow.

DETAILED DESCRIPTION OF THE PREFERRED EMBODIMENT

Figure 1:
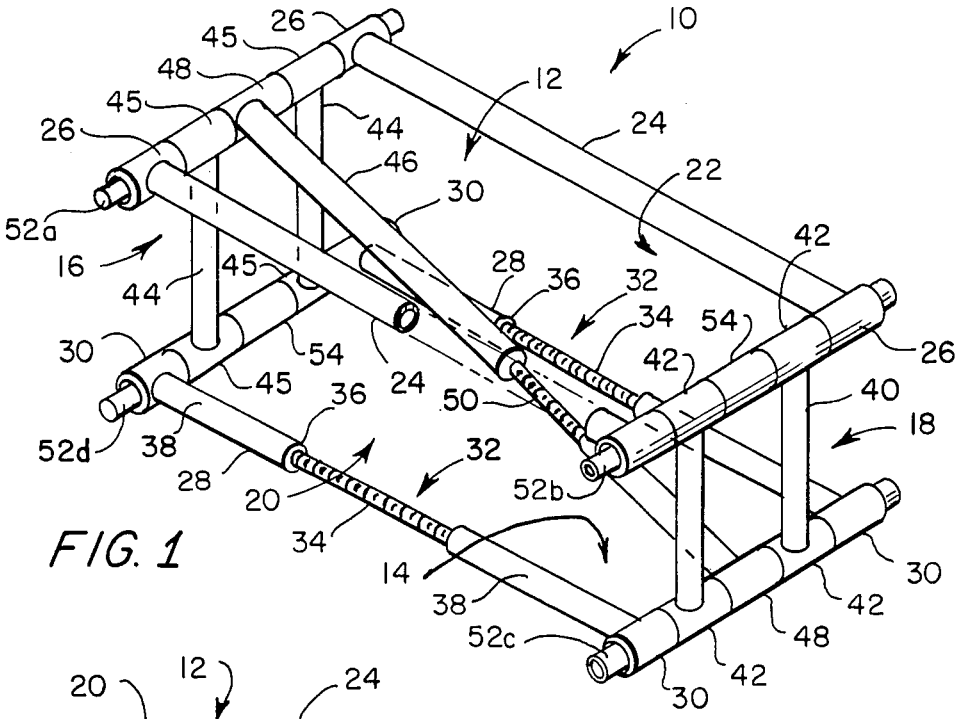
FIG. 1 is a perspective view of an adjustable modular building unit according to the present invention.
Figure 2:
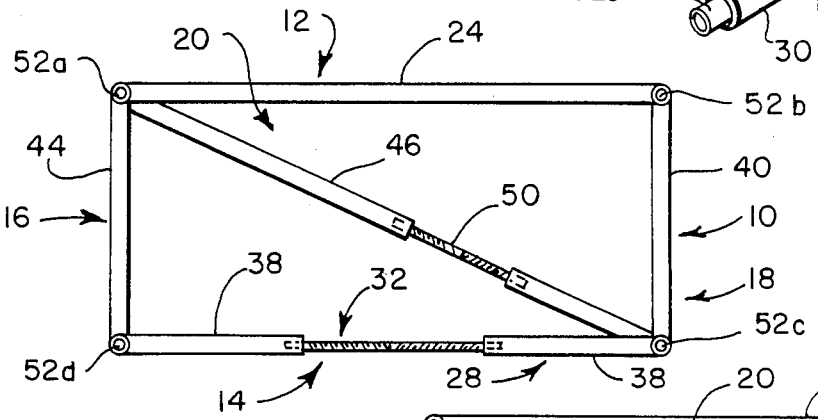
FIG. 2 is a front elevation view of the building unit depicted in FIG. 1.
Figure 3:
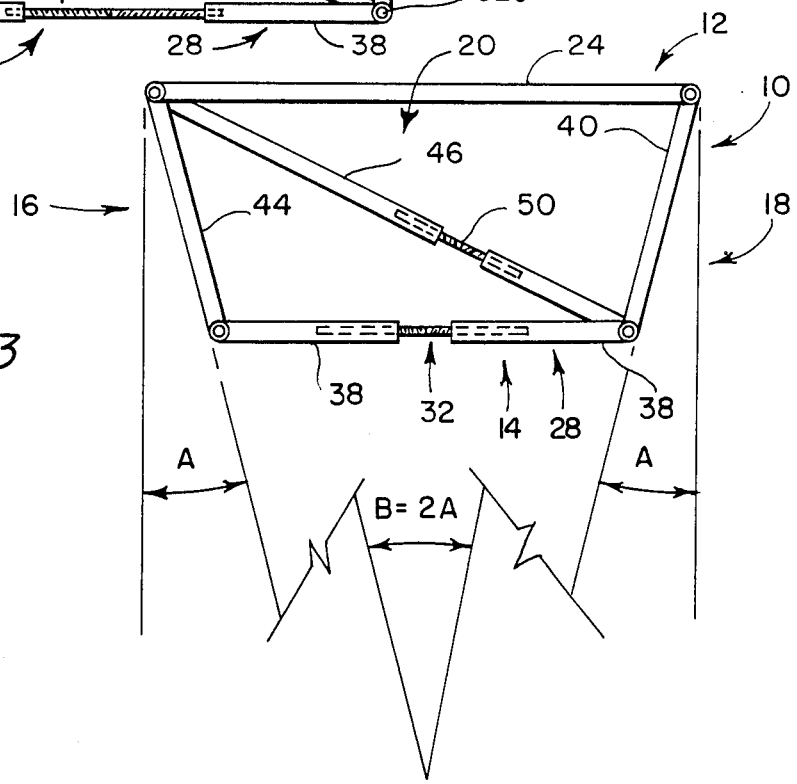
FIG. 3 is a front elevation view of the building unit depicted in FIG. 1 after adjustment.

With reference now to the drawings in which like numerals represent like elements throughout the several views, a presently preferred embodiment of an adjustable modular building unit 10 is depicted in FIGS. 1, 2 and 3. Building unit 10 is in the shape of a six-sided parallelelpiped. For the convenience of the following discussion, and realizing that the orientation of building unit 10 is variable, building unit 10 is considered to have a top side 12, a bottom side 14, a left side 16, a right side 18, a front side 20, and a back side 22. Top side 12, bottom side 14, left side 16, and right side 18 have a generally rectangular configuration no matter how adjustable modular building unit 10 is adjusted. However, front side 20 and back side 22 have a general isosceles trapezoidal shape after adjustment of building unit 10 as shown in FIG. 3.

In order to form the various sides of building unit 10, building unit 10 is formed of a number of elements or chords conveniently made from sections of pipe. Thus, two top chords 24 are provided which are of equal length and which extend parallel to one another. At the opposite ends of each top chord 24 are collars 26. As shown, collars 26 extend perpendicular to the lengths of top chords 24. Similarly, bottom chords 28 are provided which also extend parallel to one another and to top chord members 24. Bottom chord members 28 are similarly provided with collars 30. Bottom chord members 28 are made adjustable in length by use of a turnbuckle member 32. As shown, turnbuckle member 32 takes the form of a rod 34 which is oppositely threaded at each end and which is received in correspondingly threaded inserts 36. These inserts 36 are secured in chord portions 38 and 40 of bottom chord member 28 as shown.

Right chord members 40 are provided which extend parallel to one another. Each right chord member 40 is provided with a collar 42 at the end thereof which extends perpendicular to the length of the respective right chord member 40. Similarly, left chord members 44 are provided which are parallel to one another and to right chord members 40 and which have a length equal to each other and to the lengths of right chord members 40. At the end of left chord members 44 are collars 46.

Extending diagonally through building unit 10 is a diagonal base member 46. Diagonal brace member 46 has collars 48 at each end thereof which extend perpendicular to the length of diagonal brace member 46. Similar to bottom chord members 28, diagonal brace member 46 is provided with a brace adjusting means in the form of a turnbuckle member 50.

In order to form the various chord members into building unit 10, suitable connecting means are provided in form of axles 52*a*, 52*b*, 52*c*, and 52*d*. As shown, for example, axle 52*a* extends through collars 26, 45, and 48. By making axle 52 smaller than the inside diameter of collars 26, 45, and 48, top side 12 is thus rotatably connected to left side 16. It should be appreciated that although diagonal base member 46 is depicted as extending from axle 52*a* to axle 52*c*, diagonal brace member 46 could equally as well extend from axle 52*d* to axle 52*b* and still provide the same structural stability. Where diagonal brace member 46 does not extend to an axle, a spacer collar 54 is provided around that axle, such as around axles 52*b* and 52*d*, to maintain an equal spacing between the respective collars. Thus, by the use of axles 52*a*, 52*b*, 52*c*, and 52*d*, top side 12, bottom side 14, left side 16, and right side 18 are rotatably connected to the adjacent sides.

As shown in FIG. 2, modular building unit 10 in one form is provided such that front side 20 and back side 22 are rectangular in cross section. However, by appropriate adjustment of turnbuckles 32 and turnbuckles 50, modular unit 10 is adjusted as shown in FIG. 3. In this form, both front side 20 and back side 22 are in the form of isosceles trapezoids. This adjustment is made by simply rotating turnbuckles 32 to shorten the length of bottom chord members 28 and at the same time adjusting the length of diagonal brace member 46 by turnbuckle 50. This results in a rotation of left sides 16 and right side 18 relative to top side 12 equal to angle A. Thus, the angle formed by the intersection of left side 16 and right side 18 is angle B which is equal to 2A.

Figure 4:
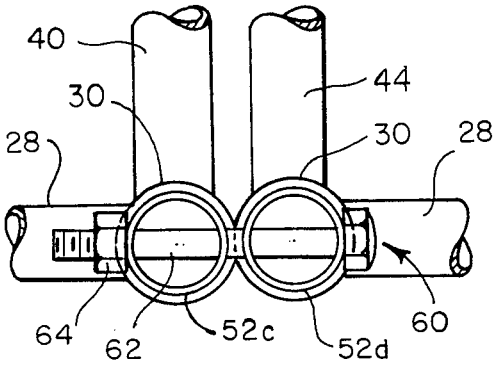
FIG. 4 is a front elevation view of portions of two adjacent building units connected together.
Figure 5:
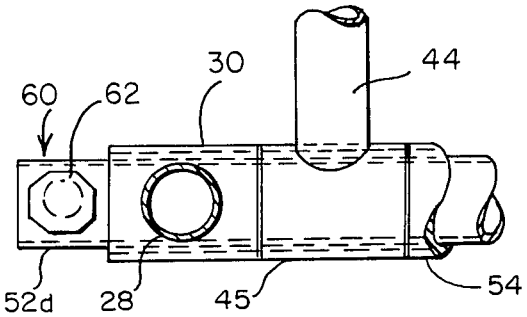
FIG. 5 is a right side view of the connected building elements depicted in FIG. 4.

In order to attach one modular building unit 10 to another modular building unit 10, a suitable attaching means 60 is provided. Attaching means 60 is depicted in FIGS. 4 and 5 attaching left side 16 of one modular building unit 10 to right side 18 of another modular building unit 10. Attaching means 60 is preferably a releasable holding device such as a bolt 62 and nut 64. As shown in the figures the portions of axles 52*c* and 52*d* extending from respective collars 30 include two apertures therein through which bolt 62 passes. Nut 64 is then attached to the threaded end of bolt 62 to secure axles 52*c* and 52*d* together at that point. By providing appropriate attaching means at both ends of axles 52*c* and 52*d*, as well as at both ends of axles 52*b* and 52*a* adjacent one another, one building element 10 is suitably secured to an adjacent building element 10.

Figure 6:
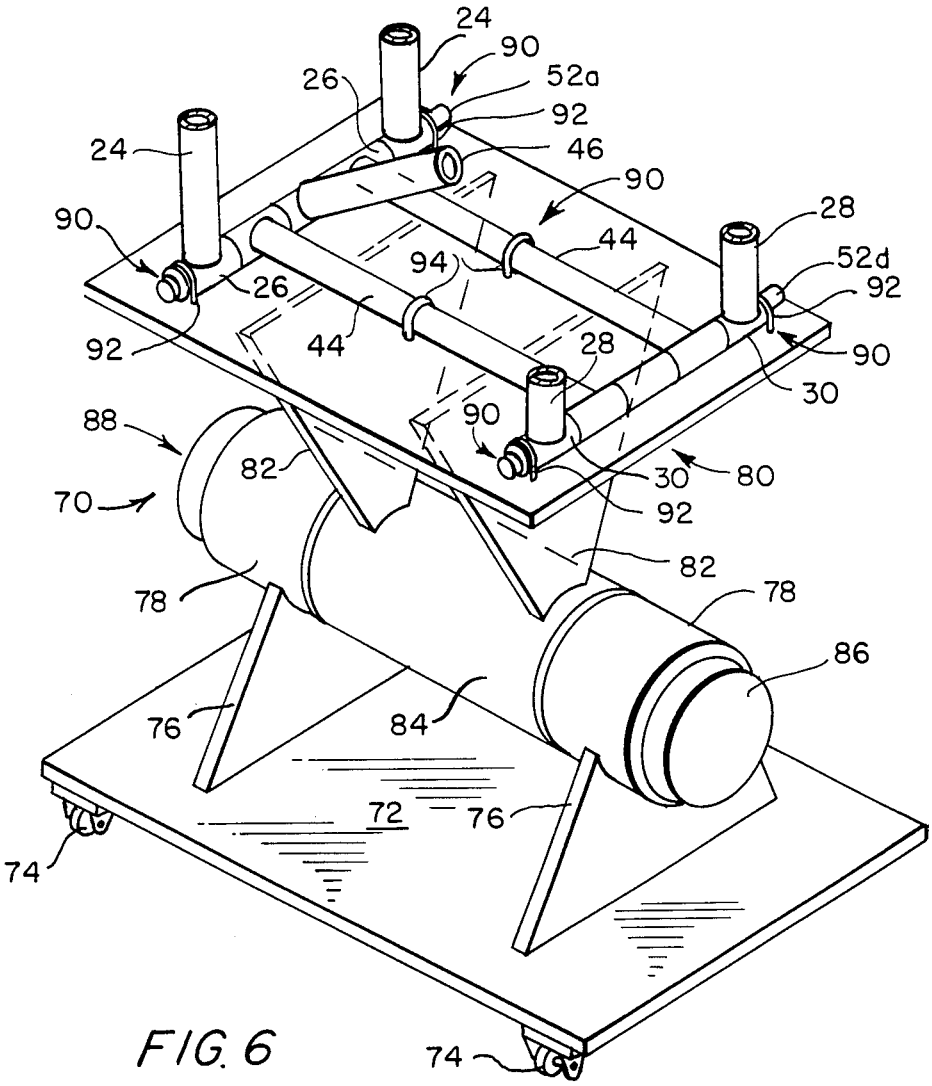
FIG. 6 is a perspective view a base unit for a truss constructed of building units of which a portion of one building unit is depicted attached to the base unit.

Depicted in FIG. 6 is a base unit 70 to which a building unit 10 (only a portion of which is shown) is suitably attached in order to construct a truss from a string of building units 10. Base unit 70 includes a base member 72. Attached to base member 72 at the four corners thereof are wheels 74 as shown. Upstanding from base member 72 are support plates 76 to which tubular members 78 are suitably attached as by welding.

Base unit 70 also includes a side engaging member 80 in the form of a flat plate. Extending from side engaging member 80 are support plates 82. Support plates 82 are securely attached to a tubular member 84. By use of a connecting pin 86 extending through tubular members 78 and tubular member 84, a suitable pivot means 88 is provided for pivotally attaching side engaging member 80 to base member 72.

As shown in FIG. 6, left side 16 of building unit 10 is suitably attached to side engaging member 80 by attaching means 90. Attaching means 90 are conveniently U bolts 92 which extend around respective collars 26 and 30 and then through side engaging member 80 where suitable nuts (not shown) hold U bolts 92 to side engaging member 80. Attaching means 90 also includes U bolts 94 which extend around left chord members 44 to hold left chord members 44 in place as well. As will be appreciated, U bolts 92 and 94 thus securely hold left side 16 and hence building unit 10 to base unit 70.

Figure 8:
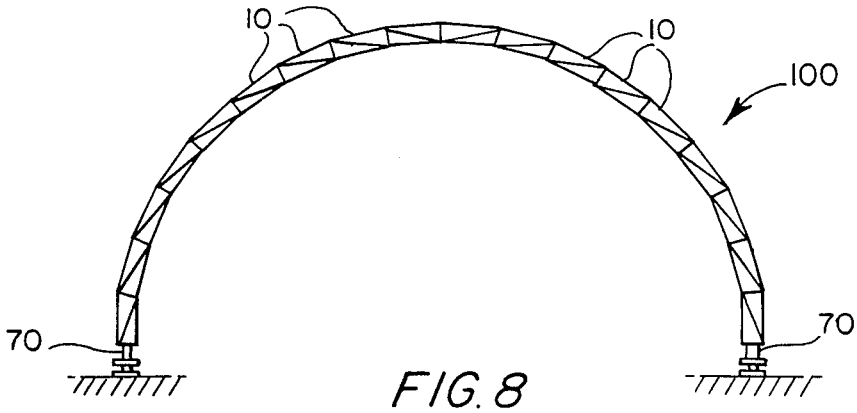
FIG. 8 is a schematic cross-sectional elevation view taken along the line 8—8 in FIG. 7.
Figure 9:
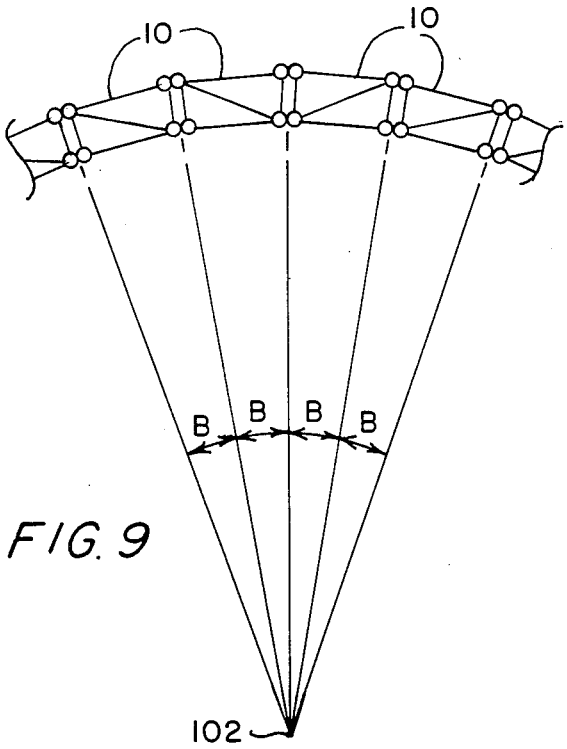
FIG. 9 is a schematic cross-sectional elevation view of a portion of a truss structure depicted in FIG. 7.

Depicted in FIG. 8 is a truss 100 which has been constructed of building units 10 and base units 70. Truss 100 take the form of semicylindrical arch, but it should be appreciated that building units 10 can be suitably adjusted to form arches which are round, ogee, lancet, basket-handle, or tudor. As shown in greater detail in FIG. 9, left side 16 and right sides 18 of each building unit 10 form an angle B which angles B intersect at a central point 102. It should be appreciated that by changing the length of bottom side 14 by suitable adjustment of bottom chord members 28 and diagonal brace member 46, the angle B is varied. This changes the span of truss 100 appropriately. Thus, it will be appreciated that a span of any desired length is suitably made by adjusting each building element 10 prior to the construction of truss 100.

Figure 7:
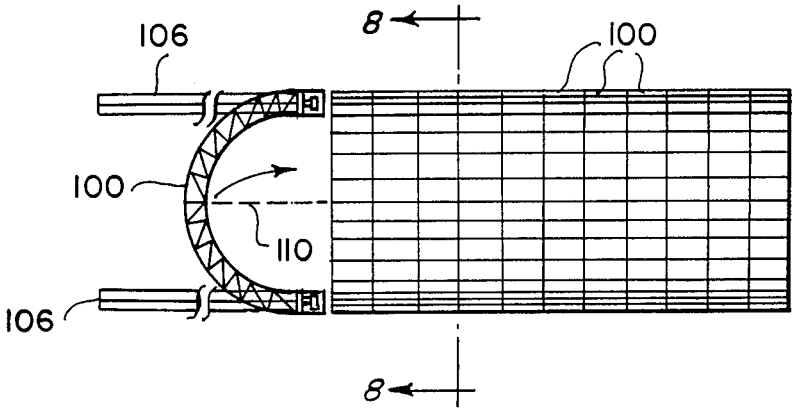
FIG. 7 is a schematic top view of a building constructed of trusses according to the present invention.
Figure 10:
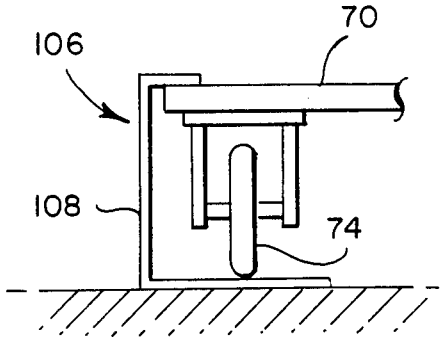
FIG. 10 is a cross-sectional elevation view of a portion of a base unit in a track.

In order to form a suitable building 104, a plurality of trusses 100 are arranged side by side as depicted in FIG. 7. If desired, a track 106 is also provided on which each base unit 70 suitably travels. As depicted in greater in FIG. 10, track 106 includes a C shaped flange 108 which traps base unit 70 to track 106. By use of track 106, each truss 100 forming building 104 is constructed out of the way of the remainder of trusses 100 and is then moved by use of wheels 74 and track 106 adjacent the remainder of the trusses so that another truss can be formed. In addition, building 104 is thus also movable along track 106 if it is desired to construct building 106 away from an object to be covered and subsequently to move building 106 over the object which is located between tracks 106.

In order to construct a building 104 of building units 10, the following method of construction is followed. Initially, it must be determined whether building 104 is to be movable. Building 104 is made movable, typically, in two instances. In one instance where building 104 is to be placed over a fixed object, building 104 is constructed adjacent the fixed object and is then moved over the fixed object. In the other instance, where an object is constructed under building 104, it may be necessary to remove building 104 in order to disasemble building 104 after the object is constructed. To accomplish this, building 104 is moved away from the constructed object. Obviously, where building 104 is simply constructed at one location, used at that location, and disassembled at that location, there is no need to move building 104.

After determining whether building 104 is to be movable, the desired span of building 104 and shape of building 104 must be determined. Once this feature is determined, the particular configuration of building units 10 which will be needed are determined. For a simple semicircular truss 100, each building unit 10 is the same and thus bottom chord members 28 and diagonal brace members 46 can be suitable adjusted for each building unit 10.

Where building 10 is to be movable, track 106 is initially provided at the appropriate location. A base unit 70 is then located in track 106 and is moved to an appropriate location by use of wheels 74. Obviously, if building 104 is not to be made movable, base unit 70 is simply located at the desired location and, with wheels 74 omitted, base member 72 is appropriately secured in place.

In order to attach the first building unit 10 to base unit 72, side engaging member 80 is moved to a vertical orientation about connecting pin 86. Then, a preadjusted building unit 10 is easily moved beside side engaging member 80 and attached to side engaging member 80 by suitable U bolts 92 and 94. After attachment, additional building units 10 are simply attached by use of attaching means 60 to the preceding building unit until truss 100 is formed in a horizontal position and includes a base unit 70 on the other side located in the adjacent track 106.

After truss 100 has been constructed in a plane parallel to horizontal, truss 100 is then rotated to vertical. This is accomplished using a suitable cable attached to the apex of the initial truss 100. Thus, the initial truss 100 is pulled to the vertical position and maintained in this position by suitable guide wires or the like. This occurs as side engaging member 80 of base unit 70 rotates from the vertical orientation to the horizontal orientation as depicted in FIG. 6. Thereafter, each additional truss 100 is constructed in a horizontal plane and suitably raised to vertical. The second and succeeding trusses 100 can be suitably raised to horizontal by a block and tackle apparatus attached at the apex of the first erected truss 100 and cable 110 (depicted schematically) attached to the apex of the truss 100 to be raised. As each additional truss 100 is raised, the raised truss 100 is attached to the proceeding truss 100 by suitable connecting devices such as scaffolding clamp connections.

After the proper number of trusses 100 are connected together to form building 104, building 104 is suitably covered with a covering material such as canvas, sheet metal, or the like. Thus, building 104 serves as a temporary structure for as long as necessary. After use of building 104, building 104 is disassembled in the same manner in which it was assembled. Thus, base units 70 and building units 10 are then available for reuse. In addition, as building units 10 are adjustable, building unit 10 can be reused in any size building at a new location.

It is anticipated that building unit 10 would suitably be constructed of two inch diameter pipe members. With such a construction, it is anticipated that a semicircular shaped building 104 made up of such building units 10 could have a diameter of 150 feet. Obviously, building unit 10 can be made of larger pipe members where a greater diameter of building 104 is desired.

Where the present invention is designed to be used as a storage building, such as a warehouse or airplane hanger, it is anticipated that the building will be directly erected at the use position. This is accomplished by suitably positioning base units 70 on a suitable foundation without the use of wheels 74. The length of the building is then dependent upon the number of trusses 100 employed. With such a storage building, the objects are equipment to be stored are moved in and out at ground level as desired. When the storage building is no longer needed, the stored objects are removed and the storage building is disassembled.

Where building 104 is to be erected over an existing structure or other fixed obstacle, tracks 106 are initially laid on either side of the object as well as to some area clear of the object but adjacent thereto. With the wheels 74 in place on base unit 70 and located in track 106, building 104 is erected adjacent to the object to be covered as described above. After building 104 is constructed, building 104 is moved along tracks 106 to a position over the object to be covered. When it is no longer desired to cover the object, such as after suitable maintenance has been performed, building 106 is moved back to the clear area adjacent the object and disassembled. Tracks 106 are then removed as well.

Where it is desired to construct an object underneath of building 104, tracks 106 are initially provided at the construction location and leading to a clear area adjacent the construction location. Building 104 is then constructed in a manner described above at the construction location. Then, after construction of the object underneath building 104, building 104 is moved by use of wheels 74 and tracks 106 to the clear area adjacent to the constructed object. At this location, building 104 is then disassembled as described above and tracks 106 removed after this disassembly.

Although the various sides have been depicted as forming a rectangular or trapezoidal frame, it should be appreciated that it might be possible to form a side from a single pipe. For example, the bottom side could be a single adjustable pipe member. With such a construction, it might also be desirable to form the left and right sides in a trapezoid, so long as a suitable connection apparatus is provided between adjacent trusses for stability.

Thus, while the present invention has been described with respect to exemplary embodiments thereof, it will be understood by those of ordinary skill in the art that variations and modifications can be effected within the scope and spirit of the invention.

I claim:

1. An adjustable modular building unit comprising:

a generally rectangular top side;

a left side and a right side which depend from said top side;

a bottom side connecting said left side and said right side;

side connecting means for rotatably connecting adjacent said sides, including a top-left connecting means, a top-right connecting means, a bottom-left connecting means, and a bottom-right connecting means;

a bottom adjusting means for adjusting the length of said bottom side;

a diagonal brace member extending diagonally between two of said side connecting means whereby said sides are held against relative rotation;

brace connecting means for rotatably connecting said brace member to the two side connecting means; and a brace adjusting means for adjusting the length of said brace member.

2. An adjustable modular building unit as claimed in claim 1 wherein said building unit has a six-sided parallelepiped shape including a generally rectangular left side, right side, and bottom side.

3. An adjustable modular building unit as claimed in claim 2 wherein said top side is formed of two top chord members of equal length which extend parallel to one another between said top-left connecting means and said top-right connecting means, wherein said bottom side is formed of two bottom chord members which extend parallel to one another and to said top chord members between said bottom-left connecting means and said bottom-right connecting means, wherein said right side is formed of two right chord members which extend parallel to one another between said top-right connecting means and said bottom-right connecting means, and wherein said left side is formed of two left chord members which extend parallel to one another and to said right chord members between said top-left connecting means and said bottom-left connecting means.

4. An adjustable modular building unit as claimed in claim 3 wherein each one of said chord members has opposite ends in the form of a rigid collar with a longitudinal axis perpendicular to the respective said chord member, and wherein each of said connecting means includes an axle passing through respective said adjacent collars.

5. An adjustable modular building unit as claimed in claim 4 wherein said brace adjusting means and said bottom adjusting means are turnbuckle members.

6. A truss structure comprising:

a plurality of modular building units, each said building unit having a six-sided parallelepiped shape and including:

(a) generally rectangular top, bottom, left and right sides, (b) a top-left connecting means for rotatably connecting said top side to said left side and a top-right connecting means for rotatably connecting said top side to said right side, (c) a bottom-left connecting means for rotatably connecting said bottom side to said left side and a bottom-right connecting means for rotatably connecting said bottom side to said right side, (d) a bottom adjusting means for adjusting the length of said bottom side between said left side and said right side, (e) a diagonal brace member extending between one set of (i) said top-left connecting means and said bottom-right connecting means and (ii) said top-right connecting means and said bottom-left connecting means, whereby said sides are held against relative rotation, (f) a top connecting means and a bottom connecting means for rotatably connecting said brace member to said one set of connecting means, and (g) a brace adjusting means for adjusting the length of said brace member; and an attaching means for attaching said right side of one said building unit to said left side of an adjacent said building unit such that a string of attached said building units form the truss structure which is configured as desired by varying the lengths of said bottom side and said diagonal brace member of each said building unit.

7. A truss structure as claimed in claim 6 and further including a base unit comprising:

a base member, a side engaging member, an attaching means for attaching one of said left side and said right side of an end building unit of the truss structure to said side engaging member, and a pivot means for pivotally attaching said side engaging member to said base member for rotation about an axis parallel to a longitudinal axis of said one of said left side and right side.

8. A truss structure as claimed in claim 7 wherein there is a said base unit at each end of the truss structure and wherein each said base member includes wheels mounted thereto whereby said truss structure is movable on said wheels.

9. A truss structure as claimed in claim 8:

wherein each said top side is formed of two top chord members of equal length which extend parallel to one another between said top-left connecting means and said top-right connecting means, wherein said bottom side is formed of two bottom chord members which extend parallel to one another and to said top chord members between said bottom-left connecting means and said bottom-right connecting means, wherein said right side is formed of two right chord members which extend parallel to one another between said top-right connecting means and said bottom-right connecting means, and wherein said left side is formed of two left chord members which extend parallel to one another and to said right chord members between said top-left connecting means and said bottom-left connecting means; and wherein each one of said chord members has opposite ends in the form of a rigid collar with a longitudinal axis perpendicular to the respective said chord member, and wherein each of said connecting means includes an axle passing through respective said adjacent collars.

10. A truss structure as claimed in claim 9 wherein said attaching means attaches said axles of one said building unit to respective adjacent said axles of an adjacent building unit.

11. A truss structure as claimed in claim 10 wherein said attaching means includes a releasable holding means for releasably holding said adjacent axles together.

12. A truss structure as claimed in claim 11 wherein said releasable holding means is a bolt which passes through both said adjacent axles and a nut secured to said bolt.

* * * * *